US011145991B1

(12) United States Patent
Livadaru et al.

(10) Patent No.: US 11,145,991 B1
(45) Date of Patent: Oct. 12, 2021

(54) SYSTEMS AND METHODS FOR PHASE-COINCIDENTIAL DUAL-POLARIZED WIDEBAND ANTENNA ARRAYS

(71) Applicant: Rockwell Collins, Inc., Cedar Rapids, IA (US)

(72) Inventors: Matilda G. Livadaru, Marion, IA (US); Jeremiah D. Wolf, Atkins, IA (US)

(73) Assignee: Rockwell Collins, Inc., Cedar Rapids, IA (US)

( * ) Notice: Subject to any disclaimer, the term of this patent is extended or adjusted under 35 U.S.C. 154(b) by 514 days.

(21) Appl. No.: 15/955,030

(22) Filed: Apr. 17, 2018

(51) Int. Cl.
*H01Q 21/06* (2006.01)
*H01Q 21/22* (2006.01)

(52) U.S. Cl.
CPC ..... *H01Q 21/062* (2013.01); *H01Q 21/22* (2013.01)

(58) Field of Classification Search
CPC .. H01Q 21/0006; H01Q 21/062; H01Q 21/22; H01Q 21/24; H01Q 21/26; H01Q 21/29; H01Q 21/293; H01Q 1/246; H01Q 1/521; H01Q 1/523; H01Q 1/525; H01Q 21/245
See application file for complete search history.

(56) References Cited

U.S. PATENT DOCUMENTS

| | | | | |
|---|---|---|---|---|
| 6,822,616 | B2 * | 11/2004 | Durham | H01Q 3/46 343/795 |
| 7,577,398 | B2 * | 8/2009 | Judd | G01S 19/25 342/357.48 |
| 8,325,093 | B2 * | 12/2012 | Holland | H01Q 9/285 343/700 MS |
| 9,172,147 | B1 * | 10/2015 | Manry, Jr. | H01Q 15/0086 |
| 9,368,879 | B1 * | 6/2016 | Manry, Jr. | H01Q 1/286 |
| 2017/0366208 | A1 * | 12/2017 | Filipovic | G01S 7/023 |
| 2018/0175512 | A1 * | 6/2018 | Isom | H01Q 1/405 |

* cited by examiner

*Primary Examiner* — Andrea Lindgren Baltzell
*Assistant Examiner* — Patrick R Holecek
(74) *Attorney, Agent, or Firm* — Suiter Swantz pc llo

(57) ABSTRACT

The antenna includes a substrate and a plurality of unit cells coupled to the substrate. Each unit cell includes a dipole feed extending from the substrate, a first antenna dipole coupled to the dipole feed, and a second antenna dipole coupled to the dipole feed. The first antenna dipole includes a first arm on a first side of the dipole feed and a second arm on a second side of the dipole feed opposite the first side. The second antenna dipole includes a third arm on a third side of the dipole feed and a fourth arm on a fourth side of the dipole feed opposite the third side.

11 Claims, 5 Drawing Sheets

--PRIOR ART--

SYSTEMS AND METHODS FOR PHASE-COINCIDENTIAL DUAL-POLARIZED WIDEBAND ANTENNA ARRAYS

BACKGROUND

The inventive concepts disclosed herein relate generally to the field of antenna arrays. More particularly, embodiments of the inventive concepts disclosed herein relates to systems and methods for phase-coincidental dual-polarized wideband antenna arrays.

Existing wide band arrays typically use a printed circuit board (e.g., card-based) design. Antenna elements are printed on a card printed circuit board, which is inserted vertically into a ground plane. For example, Vivaldi arrays, Balanced Antipodal Vivaldi Array (BAVA), and tightly-coupled dipole arrays (TCDA) may be implemented in such a manner. The card-based assembly can be a significant determinant of the cost of such arrays.

Dual polarization in antenna arrays can enable polarization diversity. In existing arrays, vertical, horizontal, and circular polarized waves can be supported. Such functionality can be necessary for electronic warfare and covert intelligence gathering by electronic means applications.

In existing dual polarization implementations, the cards are oriented orthogonal to one another, such as into an egg crate assembly. As such, the antenna feeds for each unit cell are displaced from a geometric center of each cell. For example, FIG. 1 illustrates existing system 100*a*, where antenna feeds 105*a* are located in the middle of edges of each unit cell, such that the antenna element is center-fed and displaced from the geometric center 110*a*. FIG. 1 also illustrates existing system 100*b*, where antenna feeds 105*b* are located at corners of edges of each unit cell, such that the unit cell is edge fed and thus offset relative to the antenna feeds 105*b*. Various such implementations can have high size, weight, power, and cost (SWAP-C) considerations, and can require complex polarization synthesis networks to account for the offsets between feed locations and to synthesize circular polarization.

SUMMARY

In one aspect, the inventive concepts disclosed herein are directed to an antenna including a substrate and a plurality of unit cells coupled to the substrate. Each unit cell defines a center and includes a first antenna dipole and a second antenna dipole. The first antenna dipole includes a first arm on a first side of the center and a second arm on a second side of the center opposite the first arm. The first arm includes a first arm end adjacent to the center and configured to receive a first voltage. The second arm includes a second arm end adjacent to the center and configured to receive a second voltage. The second antenna dipole includes a third arm on a third side of the center and a fourth arm on a fourth side of the center opposite the third side. The third arm includes a third arm end adjacent to the center and configured to receive a third voltage. The fourth arm includes a fourth arm end adjacent to the center and configured to receive a fourth voltage.

In a further aspect, the inventive concepts disclosed herein are directed to a method of manufacturing an antenna. The method includes providing a substrate; printing a first arm of a first antenna dipole of a unit cell on the substrate, the unit cell defining a center, the first arm having a first arm end adjacent to the center; printing a second arm of the first antenna dipole on the substrate on an opposite side of the center from the first arm, the second arm having a second arm adjacent to the center; printing a third arm of a second antenna dipole of the unit cell on the substrate, the third arm having a third arm end adjacent to the center; and printing a fourth arm of the second antenna dipole on the substrate on an opposite side of the center from the third arm, the fourth arm having a fourth arm end adjacent to the center.

BRIEF DESCRIPTION OF THE DRAWINGS

Implementations of the inventive concepts disclosed herein may be better understood when consideration is given to the following detailed description thereof. Such description makes reference to the included drawings, which are not necessarily to scale, and in which some features may be exaggerated and some features may be omitted or may be represented schematically in the interest of clarity. Like reference numerals in the drawings may represent and refer to the same or similar element, feature, or function. In the drawings.

DETAILED DESCRIPTION

Figure 1:
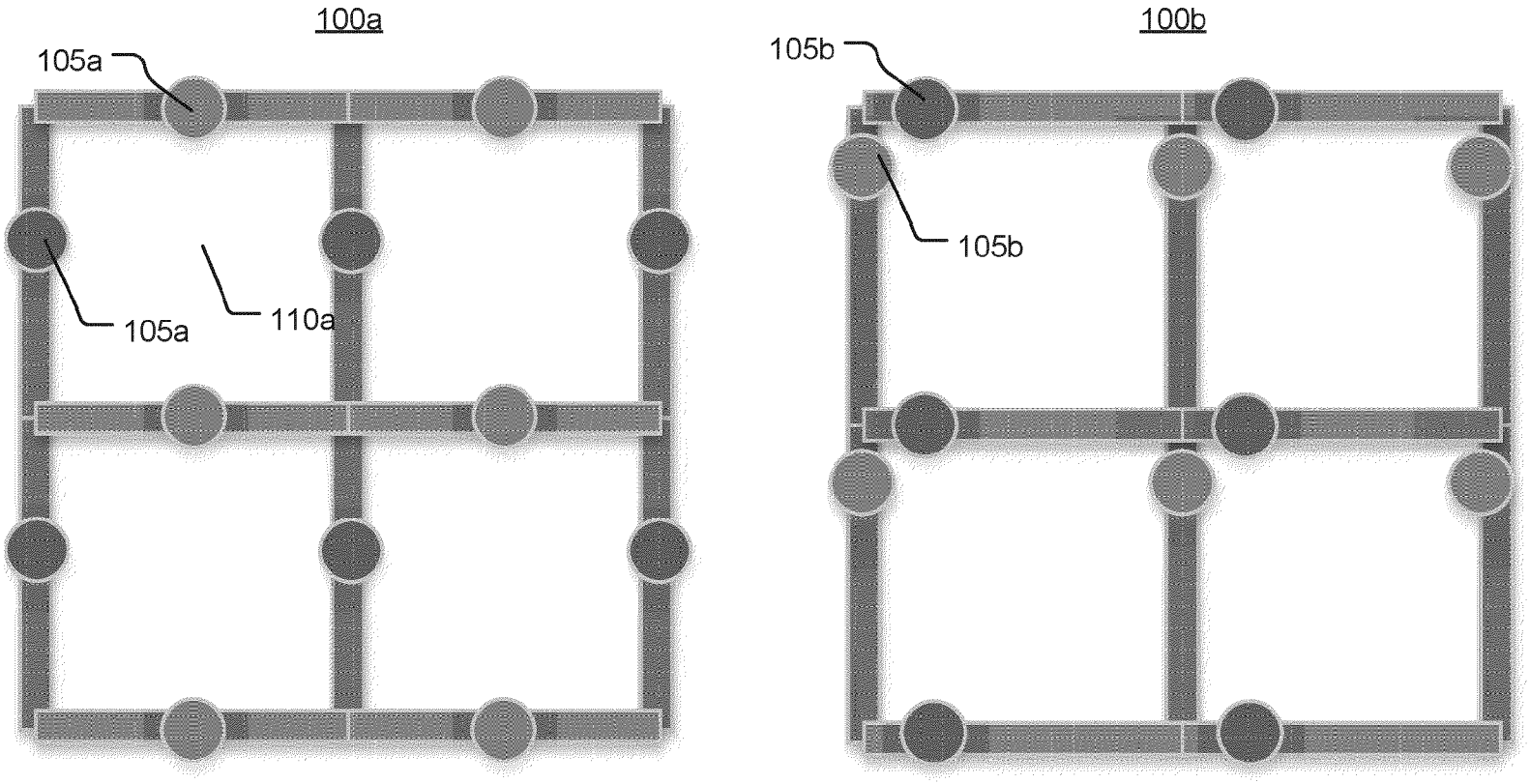
FIG. 1 illustrates top views of existing card based arrays where unit cells are fed from positions offset from a geometric center of the cell.

Before explaining at least one embodiment of the inventive concepts disclosed herein in detail, it is to be understood that the inventive concepts are not limited in their application to the details of construction and the arrangement of the components or steps or methodologies set forth in the following description or illustrated in the drawings. In the following detailed description of embodiments of the instant inventive concepts, numerous specific details are set forth in order to provide a more thorough understanding of the inventive concepts. However, it will be apparent to one of ordinary skill in the art having the benefit of the instant disclosure that the inventive concepts disclosed herein may be practiced without these specific details. In other instances, well-known features may not be described in detail to avoid unnecessarily complicating the instant disclosure. The inventive concepts disclosed herein are capable of other embodiments or of being practiced or carried out in various ways. Also, it is to be understood that the phraseology and terminology employed herein is for the purpose of description and should not be regarded as limiting.

As used herein a letter following a reference numeral is intended to reference an embodiment of the feature or element that may be similar, but not necessarily identical, to a previously described element or feature bearing the same reference numeral (e.g., 1, 1*a*, 1*b*). Such shorthand notations are used for purposes of convenience only, and should not be construed to limit the inventive concepts disclosed herein in any way unless expressly stated to the contrary.

Further, unless expressly stated to the contrary, "or" refers to an inclusive or and not to an exclusive or. For example, a condition A or B is satisfied by anyone of the following: A is true (or present) and B is false (or not present), A is false (or not present) and B is true (or present), and both A and B are true (or present).

In addition, use of the "a" or "an" are employed to describe elements and components of embodiments of the instant inventive concepts. This is done merely for convenience and to give a general sense of the inventive concepts, and "a' and "an" are intended to include one or at least one and the singular also includes the plural unless it is obvious that it is meant otherwise.

Finally, as used herein any reference to "one embodiment," or "some embodiments" means that a particular element, feature, structure, or characteristic described in connection with the embodiment is included in at least one embodiment of the inventive concepts disclosed herein. The appearances of the phrase "in some embodiments" in various places in the specification are not necessarily all referring to the same embodiment, and embodiments of the inventive concepts disclosed may include one or more of the features expressly described or inherently present herein, or any combination of sub-combination of two or more such features, along with any other features which may not necessarily be expressly described or inherently present in the instant disclosure.

Broadly, embodiments of the inventive concepts disclosed herein are directed to an antenna. The antenna includes a substrate and a plurality of unit cells coupled to the substrate. Each unit cell defines a center and includes a first antenna dipole and a second antenna dipole. The first antenna dipole includes a first arm on a first side of the center and a second arm on a second side of the center opposite the first arm. The first arm includes a first arm end adjacent to the center and configured to receive a first voltage. The second arm includes a second arm end adjacent to the center and configured to receive a second voltage. The second antenna dipole includes a third arm on a third side of the center and a fourth arm on a fourth side of the center opposite the third side. The third arm includes a third arm end adjacent to the center and configured to receive a third voltage. The fourth arm includes a fourth arm end adjacent to the center and configured to receive a fourth voltage.

The antenna can be a wideband array antenna, where the substrate is a circuit board, and the antenna dipoles are printed on a planar surface of the circuit board. The antenna dipoles can be center-fed and arranged in an orthogonal arrangement to enable dual polarization and phase coincidence. The antenna can have reduced SWAP-C as compared to existing systems; for example, the antenna can have a 50 percent height reduction as compared to existing BAVA systems. As compared to existing systems for card based arrays with offset feeds, an antenna manufactured in accordance with the inventive concepts disclosed herein can enable desired features, such as dual polarization and phase coincidence, without relying on complex polarization synthesis networks. The antenna can be used in a variety of implementations, including but not limited to portable electronic devices, airborne platforms, and ground platforms.

Figure 2:
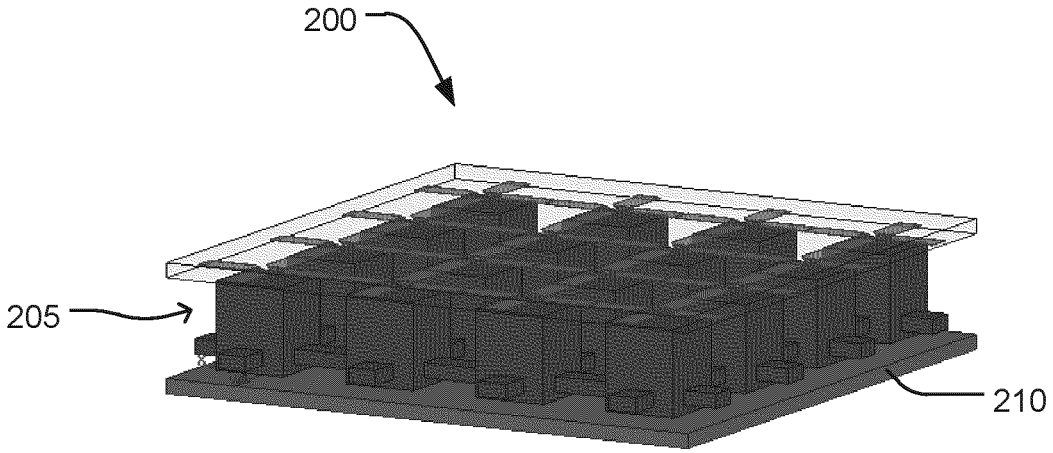
FIG. 2 is a perspective view of an exemplary embodiment of a wideband array according to the inventive concepts disclosed herein.

Referring now to FIG. 2, an embodiment of a wideband array 200 according to the inventive concepts disclosed herein includes a plurality of unit cells 205 coupled to a substrate 210. The plurality of unit cells 205 are used to receive and transmit radio frequency signals at desired frequencies, and can be configured for wideband operation. The plurality of unit cells 205 can be differentially fed voltages corresponding to desired radio frequency signals at a center of each unit cell to enable dual polarization and phase coincidence.

In some embodiments, the plurality of unit cells 205 are configured to transmit a radio frequency signal over a bandwidth extending from and including a first frequency to (and including) a second frequency. The plurality of unit cells 205 can be configured for wideband operation such that a ratio of the second frequency to the first frequency is at least two to one. In some embodiments, the first frequency is approximately 3 GHz (e.g., 3 GHz+/−100 MHz), and the second frequency is approximately 18 GHz (e.g., 18 GHz+/−100 MHz).

The plurality of unit cells 205 can be attached to and extending from the substrate 210. The plurality of unit cells 205 can extend orthogonal to the substrate 210. In some embodiments, the plurality of unit cells 205 are sized to reduce SWAP-C of the wideband array 200 as compared to existing systems. A height by which the plurality of unit cells 205 extend from the substrate 210 may be no greater than 0.5 times a wavelength of the radio frequency signal to be transmitted by the plurality of unit cells 205 at the highest frequency. For example, wherein the wideband array 200 is configured to operate from approximately 3 GHz to 18 GHz, the plurality of unit cells 205 can be sized such that the wideband array 200 has a height no greater than 0.2," providing a height reduction of at least 50% as compared to existing BAVA systems.

The substrate 210 is a circuit board, in some embodiments. The plurality of unit cells 205 can be printed on the substrate 210. In some embodiments, the substrate 210 is made from a composite and/or laminate material. For example, the substrate 210 can be made from an epoxy laminate, such as FR-4 laminate. The substrate 210 can define a planar surface on which the unit cells 205 are attached.

Figure 3:
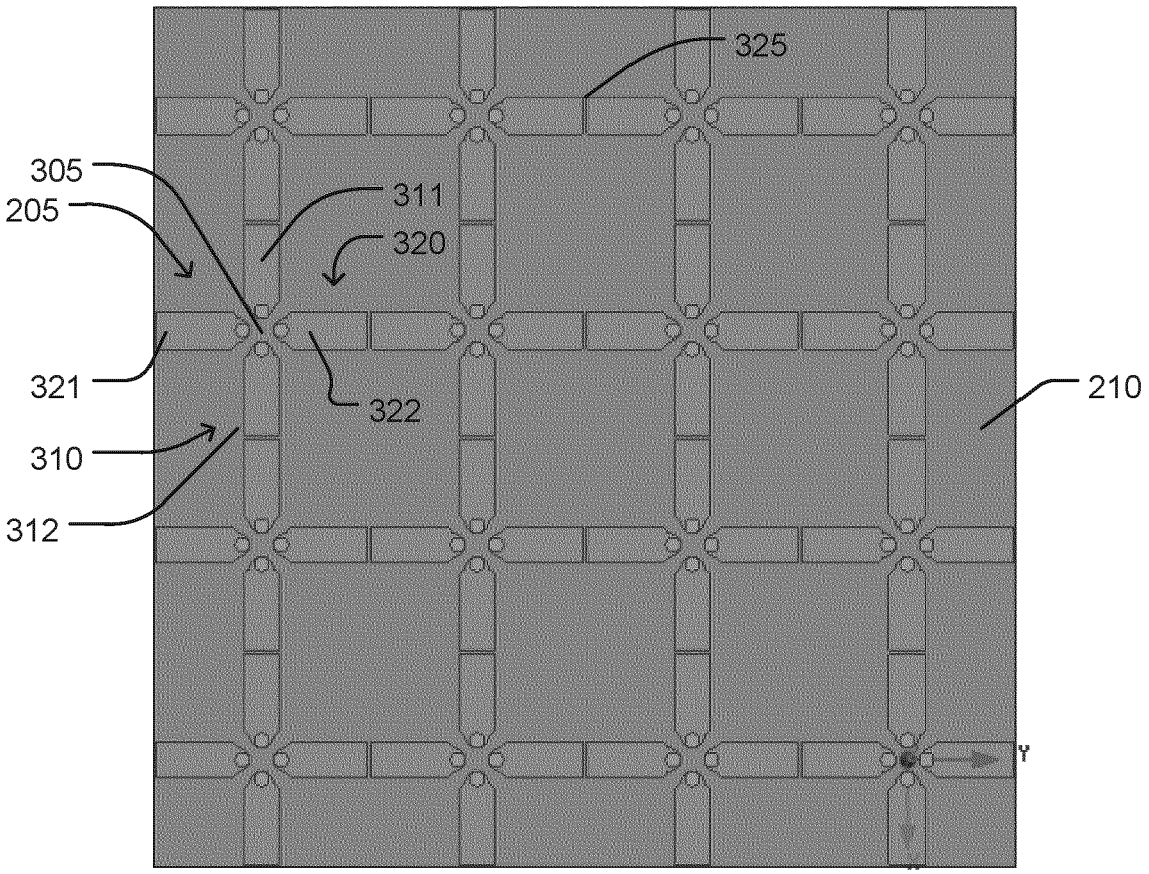
FIG. 3 is a top view of the wideband array of FIG. 2.

Referring now to FIG. 3, an embodiment of the plurality of unit cells 205 of FIG. 2 is shown according to the inventive concepts disclosed herein. Each unit cell 205 defines a center 305 and includes a first antenna dipole 310 and a second antenna dipole 320. The center 305 can be defined as a geometrical center of the unit cell 205; as an axis orthogonal to the substrate 210, substantially equidistant from each of the antenna dipoles 310, 320, and in between the antenna dipoles 310, 320; and/or a point on the axis.

The first antenna dipole 310 includes a first arm 311 on a first side of the center 305 and a second arm 312 on a second side of the center 305 opposite the first side. The first arm 311 and second arm 312 are orthogonal to the substrate 210, and can extend from the center 305 in parallel and opposite directions.

Similarly, the second antenna dipole 320 includes a third arm 321 on a third side of the center 305 and a fourth arm 322 on a fourth side of the center 305 opposite the third side. The third arm 321 and fourth arm 322 are also orthogonal to the substrate 210, and can extend from the center 305 in parallel and opposite directions. As compared to existing systems, such as shown in FIG. 1, each unit cell 205 is fed (e.g., receives) voltages differentially from the center 305 of the unit cell 205 so that there is no offset from the center 305 of the unit cell 205.

As shown in FIG. 3, the first arm 311 can be orthogonal to the third arm 321 and fourth arm 322, such that a 90 degree angle is formed between the first arm 311 and each of the third and fourth arms 321, 322 in a plane parallel to the substrate 210. Similarly, the second arm 312 is orthogonal to the third arm 321 and fourth arm 322. The arms of each unit cell 205 may be spaced from adjacent arms of adjacent unit cells 205.

Figure 4:
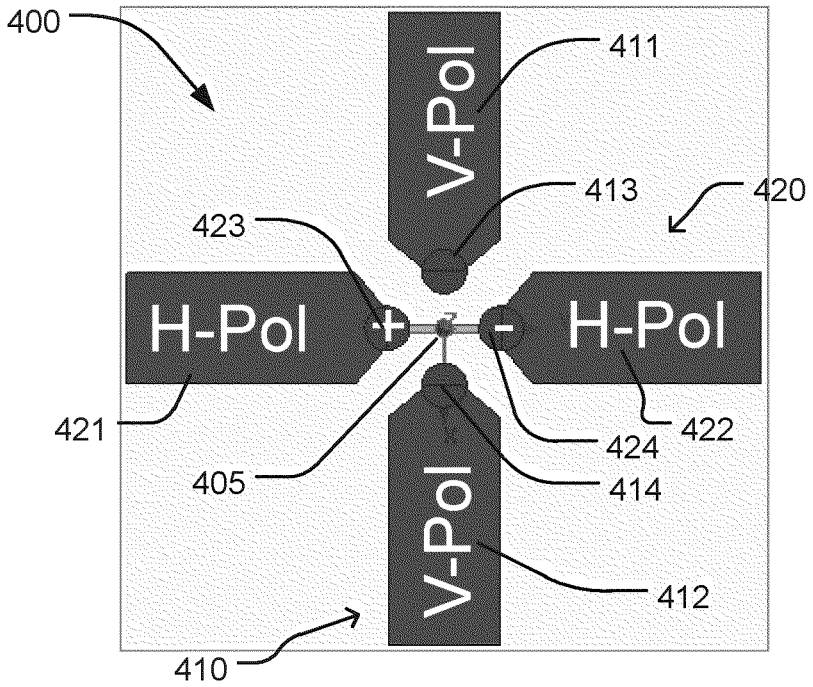
FIG. 4 is a detail view of the wideband array of FIG. 2.

Referring now to FIG. 4, an embodiment of a unit cell 400 is shown in greater detail according to the inventive concepts disclosed herein. The unit cell 400 can incorporate features of the unit cell 205 described with reference to FIGS. 2-3. The unit cell 400 defines a center 405, and includes a first antenna dipole 410 including a first arm 411 and a second arm 412, and a second antenna dipole 420 including a third arm 421 and a fourth arm 422.

The first arm 411 includes a first arm end 413 adjacent to the center 405, at which the first arm 411 receives (e.g., can be fed) a first voltage. The second arm 412 includes a second arm end 414 adjacent to the center 405, at which the second arm 412 receives a second voltage. Similarly, the third arm 421 includes a third arm end 423 adjacent to the center 405, at which the third arm receives a third voltage, and the fourth arm 422 includes a fourth arm end 424 adjacent to the center 405, at which the fourth arm receives a fourth voltage. As such, the unit cell 400 can be center-fed.

In some embodiments, the antenna dipoles 410, 420 are configured to emit radiation with phase coincidence. For example, each antenna dipole 410, 420 can define a respective first or second phase center, the respective phase center representing an apparent point at which radiation from the antenna dipole 410, 420 is emitted. The first phase center can coincide with the second phase center such that the unit cell 405 has phase coincidence. For example, the first phase center and second phase center can be identical points in space.

As shown in FIG. 4, the first antenna dipole 410 and second antenna dipole 420 can each be linearly polarized, enabling the unit cell 400 to be circularly polarized. In some embodiments, the first arm 411 can receive the first voltage at a phase of zero degrees (or a baseline phase), the second arm 412 can receive the second voltage at a phase of 180 degrees, the third arm 421 can receive the third voltage at a phase of zero degrees, and a fourth arm 422 can receive the fourth voltage at a phase of 180 degrees. Radio frequency signals and/or electric fields generated by the arms of the antenna dipoles 410, 420 can have corresponding phases.

Figure 5:
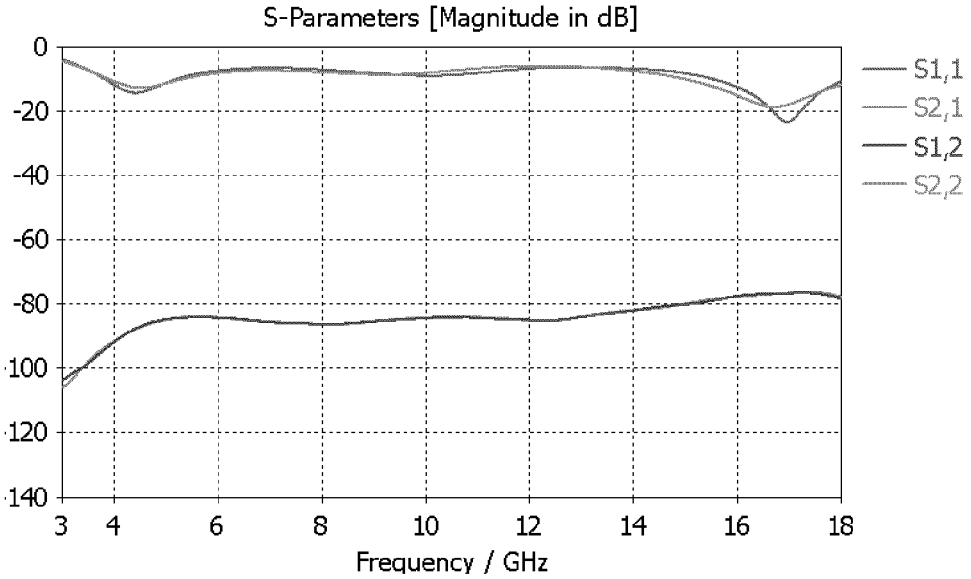
FIG. 5 is a chart of performance characteristics of the wideband array of FIG. 2.

Referring now to FIG. 5, a chart 500 illustrates performance of a wideband array (e.g., wideband array 200) configured in accordance with embodiments of the inventive concepts disclosed herein. Chart 500 illustrates isolation, based on S-parameters, between horizontally polarized and vertically polarized dipole arms, indicating that the isolation can be at least 40 dB broadside from zenith across the frequency band from 3 GHz to 18 GHz. In some embodiments, the isolation can be at least 75 dB.

Figure 6:
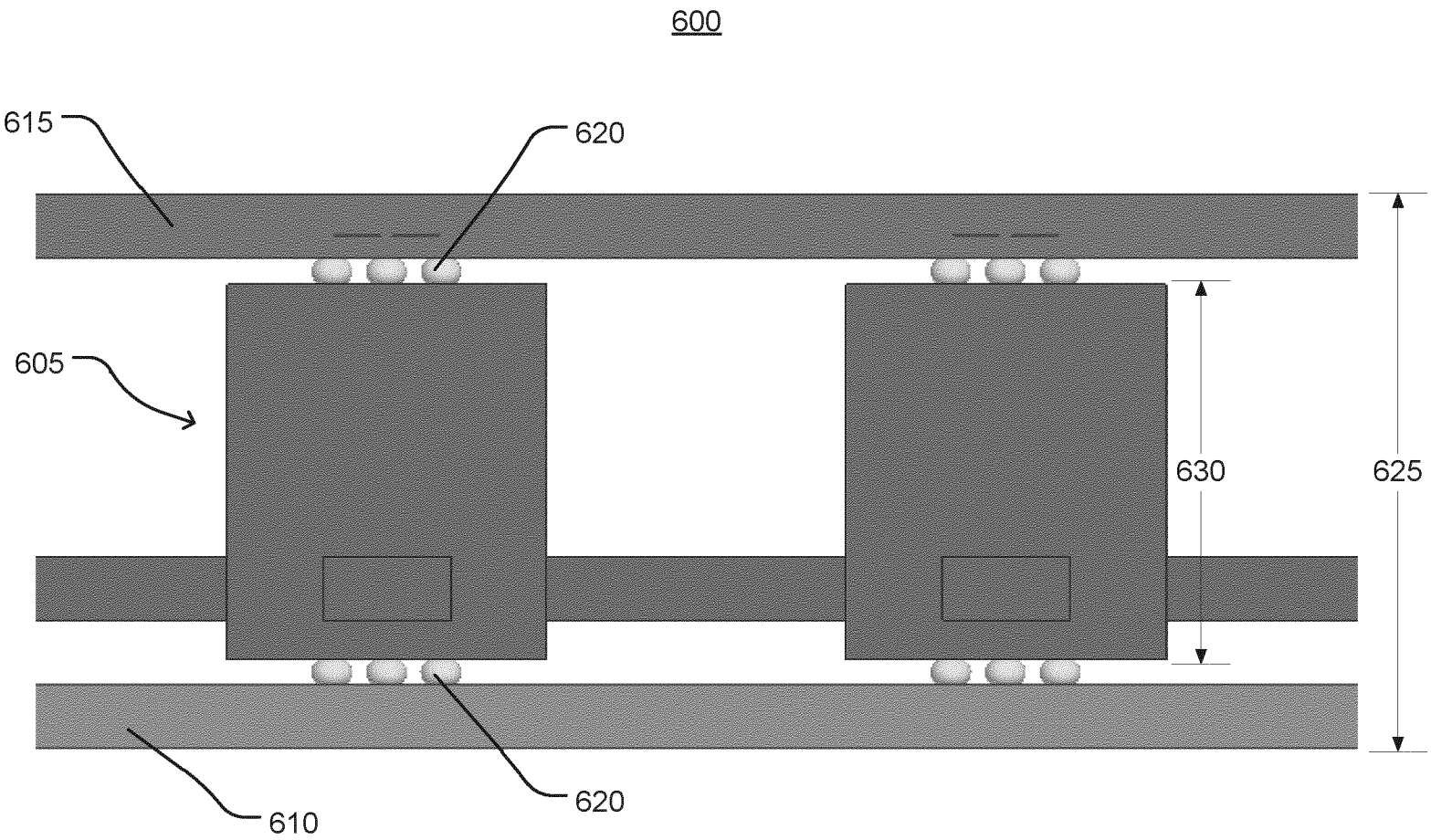
FIG. 6 is a side view of the wideband array of FIG. 2.

Referring now to FIG. 6, a side sectional view of a wideband array 600 is shown according to an embodiment of the inventive concepts disclosed herein. The wideband array 600 can incorporate features of the wideband array 200 and unit cells 205, 400 as described herein. In some embodiments, the wideband array 600 includes a plurality of unit cells 605, a substrate layer 610, and an aperture layer 615. In some embodiments, the TCDA 600 includes a plurality of spacers 620 between the unit cells 605 and the substrate layer 610 and aperture layer 615. For example, the spacers 620 can be ball grid array spacers. The performance of the wideband array 600 (e.g., as described above with respect to FIG. 5) can be similar or identical with our without the spacers 620.

In some embodiments, the TCDA 600 defines a height 625. The TCDA 600 can be sized such that the height 625 is less than existing systems. For example, where the TCDA 600 is configured to operate across a frequency band from approximately 3 GHz to 18 GHz, the height 625 may be 0.2 inches, which can provide a height reduction of at least 50% as compared to existing BAVA systems which may be manufactured to provide similar operating ranges. The height 625 may be a function of a height 630 of the unit cells 605 (e.g., height of dipole feed and/or antenna dipoles of the unit cell; height by which dipole feed and/or antenna dipoles of the unit cell extend from substrate 610). In some embodiments, the height 630 is no greater than 0.5 times a wavelength of the radio frequency signal to be transmitted by the plurality of unit cells 605 at the highest frequency.

Figure 7:
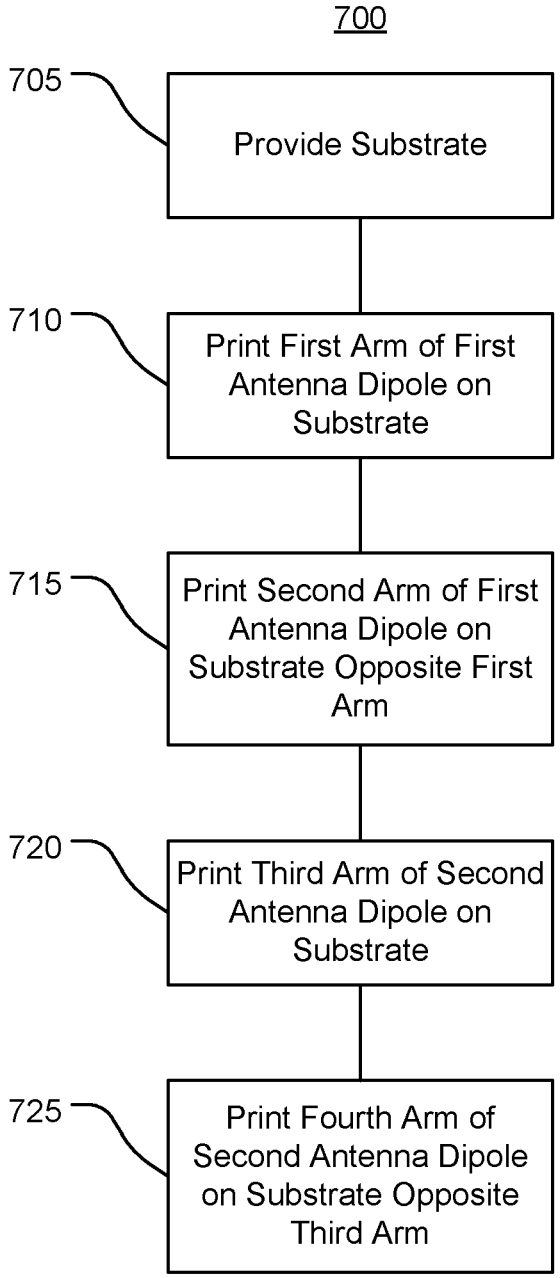
FIG. 7 is a diagram of an exemplary embodiment of a method of manufacturing an antenna according to the inventive concepts disclosed herein.

Referring now to FIG. 7, an exemplary embodiment of a method 700 for manufacturing a phase-coincident dual-polarized wideband antenna array according to the inventive concepts disclosed herein may include one or more of the following steps.

A step (705) may include providing a substrate. The substrate can be a circuit board. In some embodiments, the substrate is made from a composite and/or laminate material. For example, the substrate can be made from an epoxy laminate, such as FR-4 laminate.

A step (710) may include printing a first arm of a first antenna dipole of a unit cell on the substrate. For example, where the substrate is a circuit board, the first arm can be printed on the substrate. The unit cell defines a center. The first arm has a first arm end adjacent to the center. The first arm can be printed on the substrate to extend orthogonal to the substrate. The first arm can receive a first voltage at the first arm end.

A step (715) may include printing a second arm of the first antenna dipole on the substrate on an opposite side of the center from the first arm. Similar to the first arm, the second arm can be printed on the substrate where the substrate is a circuit board, and can extend orthogonal to the substrate. The second arm has a second arm end adjacent to the center. The second arm can receive a second voltage (which may be out of phase from the first voltage by 180 degrees) at the second arm end.

A step (720) may include printing a third arm of a second antenna dipole of the unit cell to the substrate. The third arm can be printed on the substrate where the substrate is a circuit board, and can be printed to the substrate to extend orthogonal to the substrate. The third arm can be orthogonal to the first and second arms (e.g., spaced 90 degrees from each of the first and second arms in a plane parallel to the substrate). The third arm includes a third arm end adjacent to the center, and can receive a third voltage at the third arm end. The third voltage can be of the same phase as the first voltage.

A step (725) may include printing a fourth arm of the second antenna dipole to the substrate on an opposite side of the center from the third arm. Similar to the third arm, the fourth arm can be printed on the substrate where the substrate is a circuit board, and can be orthogonal to the substrate. The fourth arm can be orthogonal to the first and second arms (e.g., spaced 90 degrees from each of the first and second arms in a plane parallel to the substrate). The fourth arm includes a fourth arm end adjacent to the center, and can receive a fourth voltage at the fourth arm end. The fourth voltage can be of the same phase as the second voltage (e.g., 180 degrees out of phase from the first and third voltages).

As will be appreciated from the above, antennas/antenna arrays according to embodiments of the inventive concepts disclosed herein may have reduced SWAP-C as compared to existing systems, while enabling dual polarization and phase coincidence, by feeding antenna dipoles from the geometric center of unit cells. The antennas/antenna arrays can have isolation between horizontal and vertical polarization of at least 40 dB at broadside for the full operational bandwidth and, in some embodiments, at least 75 dB.

It is to be understood that embodiments of the methods according to the inventive concepts disclosed herein may include one or more of the steps described herein. Further, such steps may be carried out in any desired order and two or more of the steps may be carried out simultaneously with one another. Two or more of the steps disclosed herein may be combined in a single step, and in some embodiments, one or more of the steps may be carried out as two or more sub-steps. Further, other steps or sub-steps may be carried in addition to, or as substitutes to one or more of the steps disclosed herein.

From the above description, it is clear that the inventive concepts disclosed herein are well adapted to carry out the objects and to attain the advantages mentioned herein as well as those inherent in the inventive concepts disclosed herein. While presently preferred embodiments of the inventive concepts disclosed herein have been described for purposes of this disclosure, it will be understood that numerous changes may be made which will readily suggest themselves to those skilled in the art and which are accomplished within the broad scope and coverage of the inventive concepts disclosed and claimed herein.

What is claimed is:

1. An antenna, comprising:

a substrate;

a plurality of unit cells coupled to a surface of the substrate, each unit cell defining a center, each unit cell including:

a first antenna dipole including a first arm on a first side of the center and a second arm on a second side of the center opposite the first side, the first arm including a first arm end adjacent to the center and configured to receive a first voltage, the second arm including a second arm end adjacent to the center and configured to receive a second voltage; and a second antenna dipole including a third arm on a third side of the center and a fourth arm on a fourth side of the center opposite the third side, the third arm including a third arm end adjacent to the center and configured to receive a third voltage, the fourth arm including a fourth arm end adjacent to the center and configured to receive a fourth voltage; and an aperture layer coupled to the plurality of unit cells;

wherein the plurality of unit cells are configured to transmit a radio frequency signal over a bandwidth extending between and including a first frequency to a second frequency, wherein the first frequency is approximately 3 GHz, wherein the second frequency is approximately 18 GHz, wherein a measure of isolation between the first dipole antenna and the second dipole antenna is at least 40 dB broadside from zenith across the bandwidth.

2. The antenna of claim 1, wherein the substrate is a circuit board, and the first antenna dipole and second antenna dipole are printed on the circuit board.

3. The antenna of claim 1, wherein the first voltage is out of phase from the second voltage by 180 degrees.

4. The antenna of claim 1, wherein an electric field generated by the first arm based on the first voltage is at a phase of zero degrees, an electric field generated by the second arm based on the second voltage is at a phase of 180 degrees, an electric field generated by the third arm based on the third voltage is at a phase of zero degrees, and an electric field generated by the fourth arm based on the fourth voltage is at a phase of 180 degrees.

5. The antenna of claim 4, wherein the first antenna dipole is configured to be vertically polarized, the second antenna dipole is configured to be horizontally polarized, and each unit cell is configured to be circularly polarized.

6. The antenna of claim 5, wherein a first phase center representing an apparent point at which radiation is emitted by the first antenna dipole coincides with a second phase center representing an apparent point at which radiation is emitted by the second antenna dipole.

7. The antenna of claim 1, wherein the substrate is made from an FR-4 laminate.

8. The antenna of claim 1, wherein a height by which the plurality of dipole feeds extend from the substrate is no greater than 0.5 times a wavelength corresponding to the second frequency.

9. The antenna of claim 1, wherein the first antenna dipole and second antenna dipole are orthogonal to the substrate.

10. The antenna of claim 1, wherein the measure of isolation between the first dipole antenna and the second dipole antenna is at least 75 dB broadside from zenith across the bandwidth.

11. The antenna of claim 1, wherein for each unit cell, the arms of the antenna dipoles are spaced 90 degrees apart from adjacent arms.

* * * * *